US008437926B2

(12) United States Patent
Shintani et al.

(10) Patent No.: US 8,437,926 B2
(45) Date of Patent: May 7, 2013

(54) CONTROL DEVICE AND PITCH ANGLE CONTROL METHOD

(75) Inventors: Satoru Shintani, Hirakata (JP); Tomohiro Nakagawa, Hirakata (JP); Ryouichi Nagasaka, Fujisawa (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/634,494

(22) PCT Filed: Jan. 6, 2012

(86) PCT No.: PCT/JP2012/050193

§ 371 (c)(1),
(2), (4) Date: Sep. 12, 2012

(87) PCT Pub. No.: WO2012/093729

PCT Pub. Date: Jul. 12, 2012

(65) Prior Publication Data

US 2013/0000930 A1 Jan. 3, 2013

(30) Foreign Application Priority Data

Jan. 6, 2011 (JP) ..... 2011-001417

(51) Int. Cl.
*G06F 19/00* (2011.01)

(52) U.S. Cl.
USPC ..... 701/50; 172/4.5

(58) Field of Classification Search ..... 172/2–11, 172/779–788, 799, 779.5, 816–830; 37/348, 37/301; 701/40, 50, 56, 63
See application file for complete search history.

(56) References Cited

U.S. PATENT DOCUMENTS

| | | | | |
|---|---|---|---|---|
| 5,996,703 | A * | 12/1999 | Yamamoto et al. | 172/4.5 |
| 6,035,241 | A * | 3/2000 | Yamamoto | 700/40 |
| 6,273,198 | B1 * | 8/2001 | Bauer et al. | 172/825 |
| 6,282,453 | B1 * | 8/2001 | Lombardi | 700/63 |
| 6,863,461 | B2 * | 3/2005 | Werner | 403/43 |
| 7,121,355 | B2 * | 10/2006 | Lumpkins et al. | 172/4.5 |
| 8,141,650 | B2 * | 3/2012 | Breiner et al. | 172/4.5 |

FOREIGN PATENT DOCUMENTS

| | | |
|---|---|---|
| JP | 7-166575 A | 6/1995 |
| JP | 7-180176 A | 7/1995 |

OTHER PUBLICATIONS

International Search Report of corresponding PCT Application No. PCT/JP2012/050193.

* cited by examiner

*Primary Examiner* — Robert Pezzuto
(74) *Attorney, Agent, or Firm* — Global IP Counselors, LLP

(57) ABSTRACT

A control device for automatically controlling a pitch angle of a blade includes a hydraulic oil amount calculation unit and an open ratio setting unit. The hydraulic oil amount calculation unit is configured to calculate an amount of hydraulic oil passing through a blade tilt cylinder valve. The open ratio setting unit is configured to cause the blade tilt cylinder valve to open at a predetermined open ratio when a request for the pitch angle to be changed has been received, to cause the blade tilt cylinder valve to close when the calculated amount of hydraulic oil has reached a predetermined amount of hydraulic oil required for the change of the tilt angle, and to cause the open ratio to be smaller than the predetermined open ratio while a request for a predetermined action necessitating that hydraulic oil be supplied from a main valve is being received.

14 Claims, 9 Drawing Sheets

CONTROL DEVICE AND PITCH ANGLE CONTROL METHOD

CROSS-REFERENCE TO RELATED APPLICATIONS

This application claims priority to Japanese Patent Application No. 2011-001417 filed on Jan. 6, 2011, the disclosure of which is hereby incorporated herein by reference in its entirety.

TECHNICAL FIELD

The present invention relates to a control device for controlling the pitch angle of a blade, and to a pitch angle control method.

BACKGROUND ART

In general, construction machine such as a bulldozer is provided with a blade. The primary modes of work for such construction machine are digging, earth moving, and earth removal; the angle of incline of the blade relative to the ground (hereinbelow called the "pitch angle") is preferably set to a suitable angle in accordance with the work mode, in order to improve work efficiency.

With the purpose of reducing the burden on an operator, there has been proposed a technique for automatically setting the pitch angle in accordance with the work mode (hereinbelow called "auto-pitch control") (see Japanese Laid-open Patent Publication 7-166575). In this publication, the pitch angle is detected by calculating the stroke of a blade tilt cylinder, on the basis of an amount of hydraulic oil supplied to the blade tilt cylinder from a main valve. The amount of hydraulic oil supplied to the blade tilt cylinder is calculated on the basis of the supply time and the opening area of a blade tilt cylinder valve constituting the main valve.

SUMMARY

However, in the above-mentioned publication, when the hydraulic oil is supplied to the blade tilt cylinder or another cylinder during the execution of the auto-pitch control, there is a reduction in the amount of hydraulic oil supplied to the blade tilt cylinder valve within the main valve. For this reason, it is sometimes impossible to supply hydraulic oil to the entire opening area of the blade tilt cylinder valve. In such a case, when the amount of hydraulic oil is calculated on the basis of the opening area of the blade tilt cylinder valve, an error exists between the calculated amount of hydraulic oil and the amount of hydraulic oil actually having been supplied; therefore, the pitch angle cannot be controlled with precision.

A purpose of the present invention, having been contrived in view of the foregoing circumstances, is to provide a control device and pitch angle control method whereby the pitch angle of a blade can be controlled with precision.

A control device according to a first aspect of the present invention is a control device for automatically controlling a pitch angle of a blade relative to the ground, the control device being provided to construction machine including the blade, a blade tilt cylinder and a blade tilt cylinder valve constituting a part of a main valve, the blade tilt cylinder valve being linked to the blade tilt cylinder. The control device includes a hydraulic oil amount calculation unit and an open ratio setting unit. The hydraulic oil amount calculation unit calculates, on the basis of the open ratio and a cumulative time of opening of the blade tilt cylinder valve, an amount of hydraulic oil passing through the blade tilt cylinder valve. The open ratio setting unit causes the blade tilt cylinder valve to open at a predetermined open ratio when a request for the pitch angle to be changed from a first angle to a second angle has been received, and causes the blade tilt cylinder valve to close when the calculated amount of hydraulic oil has reached a predetermined amount of hydraulic oil required for the change from the first angle to the second angle. The open ratio setting unit causes the open ratio to be smaller than a predetermined open ratio while receiving a request for a predetermined action necessitating that hydraulic oil be supplied from the main valve.

In the control device according to the first aspect of the present invention, the open ratio of the blade tilt cylinder valve is made to be smaller in a case where, during the execution of an auto-pitch control, hydraulic oil of the main valve is used for a predetermined action. For this reason, hydraulic oil of the entire opening of the blade tilt cylinder valve is more readily supplied to the blade tilt cylinder, and therefore the occurrence of an error between the amount of hydraulic oil as calculated by the hydraulic oil amount calculation unit and the predetermined amount of hydraulic oil can be suppressed. Accordingly, the stroke of the blade tilt cylinder can be detected with precision, and therefore the pitch angle of the blade can be controlled with precision.

A control device according to a second aspect of the present invention relates to the first aspect, wherein the predetermined action is a lifting of the blade.

A control device according to a third aspect of the present invention relates to the first aspect, wherein the predetermined action is a course change.

A control device according to a fourth aspect of the present invention relates to the first aspect, wherein the predetermined action is a tilting of the blade.

A control device according to a fifth aspect of the present invention relates to the first aspect, wherein the predetermined action is a lifting of a ripper for excavation.

A control device according to a sixth aspect of the present invention relates to the first aspect, wherein the predetermined action is a tilting of a ripper for excavation.

A control device according to a seventh aspect of the present invention relates to any of the fourth through sixth aspects, wherein the open ratio setting unit causes the blade tilt cylinder valve to close while the request for the predetermined action is being received.

In the control device according to the seventh aspect of the present invention, the auto-pitch control is interrupted in a case where it is necessary to supply a large amount of hydraulic oil from the main valve. For this reason, there is no need to make the difficult prediction of the extent to which the open ratio of the blade tilt cylinder valve should be made smaller. Accordingly, the occurrence of an error between the calculated amount of hydraulic oil and the predetermined amount of hydraulic oil can be further suppressed, and therefore the pitch angle of the blade can be controlled with greater precision.

A control device according to an eighth aspect of the present invention relates to the first aspect, wherein, when a request to change the pitch angle has been received, the open ratio setting unit sets the open ratio in conformity with the received request.

According to the control device according to the eighth aspect of the present invention, operation by the operator is given priority even during the execution of the auto-pitch control in a case where the operator wishes to independently change the pitch angle. For this reason, the degree of freedom of operation by the operator can be improved.

A control device according to a ninth aspect of the present invention relates to any of the first through eighth aspects, wherein, while the open ratio is being made smaller than the predetermined open ratio, the open ratio setting unit causes a monitor to display that the open ratio is being made smaller than the predetermined open ratio.

In the control device according to the ninth aspect of the present invention, it is possible to effectively alert the operator that the auto-pitch control has been interrupted and/or that the auto-pitch control is being delayed.

A control device according to a tenth aspect of the present invention relates to the first aspect, comprising an engine rotational speed acquisition unit for acquiring the rotational speed of an engine, and a maximum open ratio determination unit for determining the maximum open ratio of the blade tilt cylinder valve in accordance with the rotational speed of the engine. The predetermined open ratio is the maximum open ratio.

A control device according to an eleventh aspect of the present invention relates to the first aspect, comprising a hydraulic oil amount monitoring unit for monitoring whether or not the calculated amount of hydraulic oil has reached the predetermined amount of hydraulic oil required for the change from the first angle to the second angle. The hydraulic oil amount monitoring unit communicates to the open ratio setting unit that the calculated amount of hydraulic oil has reached the predetermined amount of hydraulic oil.

A control device according to a twelfth aspect of the present invention relates to the first aspect, comprising a work mode detection unit for detecting a subsequent work mode of the blade in accordance with a work mode of the blade when the request for the pitch angle to be changed from the first angle to the second angle is received. The predetermined amount of hydraulic oil is set in accordance with the detected subsequent work mode.

A bulldozer according to a thirteenth aspect of the present invention comprises: a blade; a blade tilt cylinder for driving the blade; a main valve including a blade tilt cylinder valve linked to the blade tilt cylinder; a hydraulic pump for supplying hydraulic oil to the main valve, the hydraulic pump being driven by an engine; and a control device for automatically controlling the pitch angle of the blade relative to the ground. The control device comprises a hydraulic oil amount calculation unit and an open ratio setting unit. The hydraulic oil amount calculation unit calculates, on the basis of the open ratio of and a cumulative time of opening of the blade tilt cylinder valve, an amount of hydraulic oil passing through the blade tilt cylinder valve. The open ratio setting unit causes the blade tilt cylinder valve to open at a predetermined open ratio in a case where a request for the pitch angle to be changed from a first angle to a second angle has been received, and causes the blade tilt cylinder valve to close in a case where the calculated amount of hydraulic oil has reached a predetermined amount of hydraulic oil required for the change from the first angle to the second angle. The open ratio setting unit causes the open ratio to be smaller than a predetermined open ratio while a request for a predetermined action necessitating that hydraulic oil be supplied from the main valve is being received.

A pitch angle control method according to a fourteenth aspect of the present invention is a method for automatically controlling a pitch angle of a blade relative to the ground in construction machine comprising: the blade; a blade tilt cylinder; and a blade tilt cylinder valve constituting a part of a main valve, the blade tilt cylinder valve being linked to the blade tilt cylinder. A pitch angle control method according to the fourteenth aspect of the present invention comprises: a step for causing the blade tilt cylinder valve to open at a predetermined open ratio in a case where a request for the pitch angle to be changed from a first angle to a second angle has been received; a step for causing the open ratio to be smaller than the predetermined open ratio while receiving a request for a predetermined action necessitating that hydraulic oil be supplied from the main valve; a step for calculating, on the basis of the open ratio of and the cumulative time of opening of the blade tilt cylinder valve, an amount of hydraulic oil passing through the blade tilt cylinder valve; and a step for causing the blade tilt cylinder valve to close in a case where the calculated amount of hydraulic oil has reached a predetermined amount of hydraulic oil required for the change from the first angle to the second angle.

According to the present invention, there can be provided a control device and pitch angle control method whereby the pitch angle of a blade can be controlled with precision.

DETAILED DESCRIPTION OF EMBODIMENTS

Figure 1:
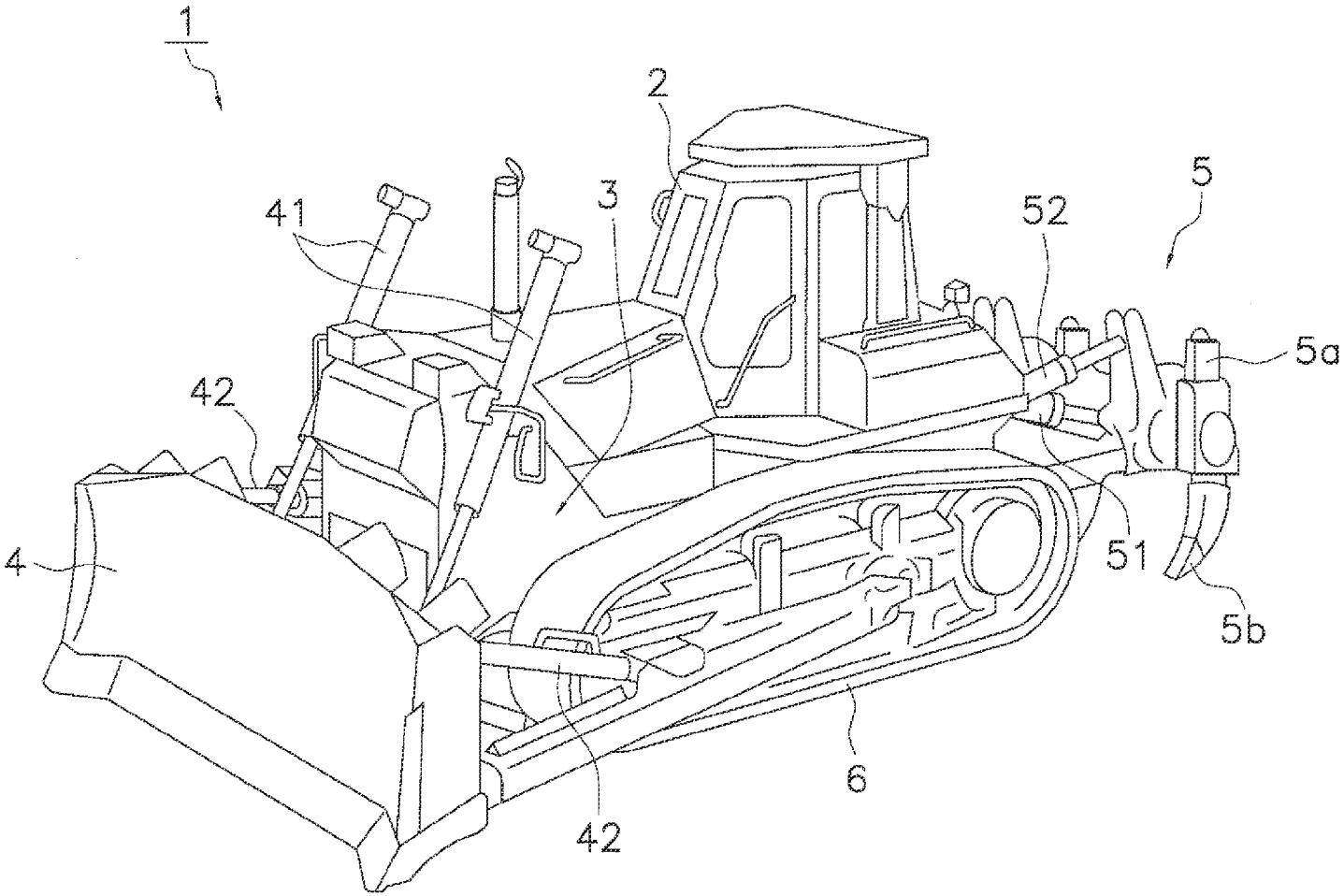
FIG. 1 is a perspective view of a bulldozer 1 according to an embodiment.

A description of an embodiment of the present invention shall now be provided, with reference to the accompanying drawings. In the following recitation of the drawings, like or similar portions have been assigned like or similar reference numerals. The drawings are schematic, and the ratios in each of the dimensions and the like may in some cases be different from reality. Accordingly, the specific dimensions and the like should be evaluated by consulting the following description. It will be readily understood that the interrelationships between the drawings also include portions having mutually different dimensional relationships and ratios.

In the present embodiment, a description of a bulldozer is provided as an example of construction machine.

Overall Configuration of Bulldozer 1

A description of a configuration of a bulldozer 1 according to the embodiment shall now be provided with reference to the accompanying drawings. FIG. 1 is a perspective view of the bulldozer 1 according to the embodiment.

The bulldozer 1 comprises a cab 2, a vehicle body frame 3, a blade 4, a ripper 5, and a travel device 6.

Figure 3:
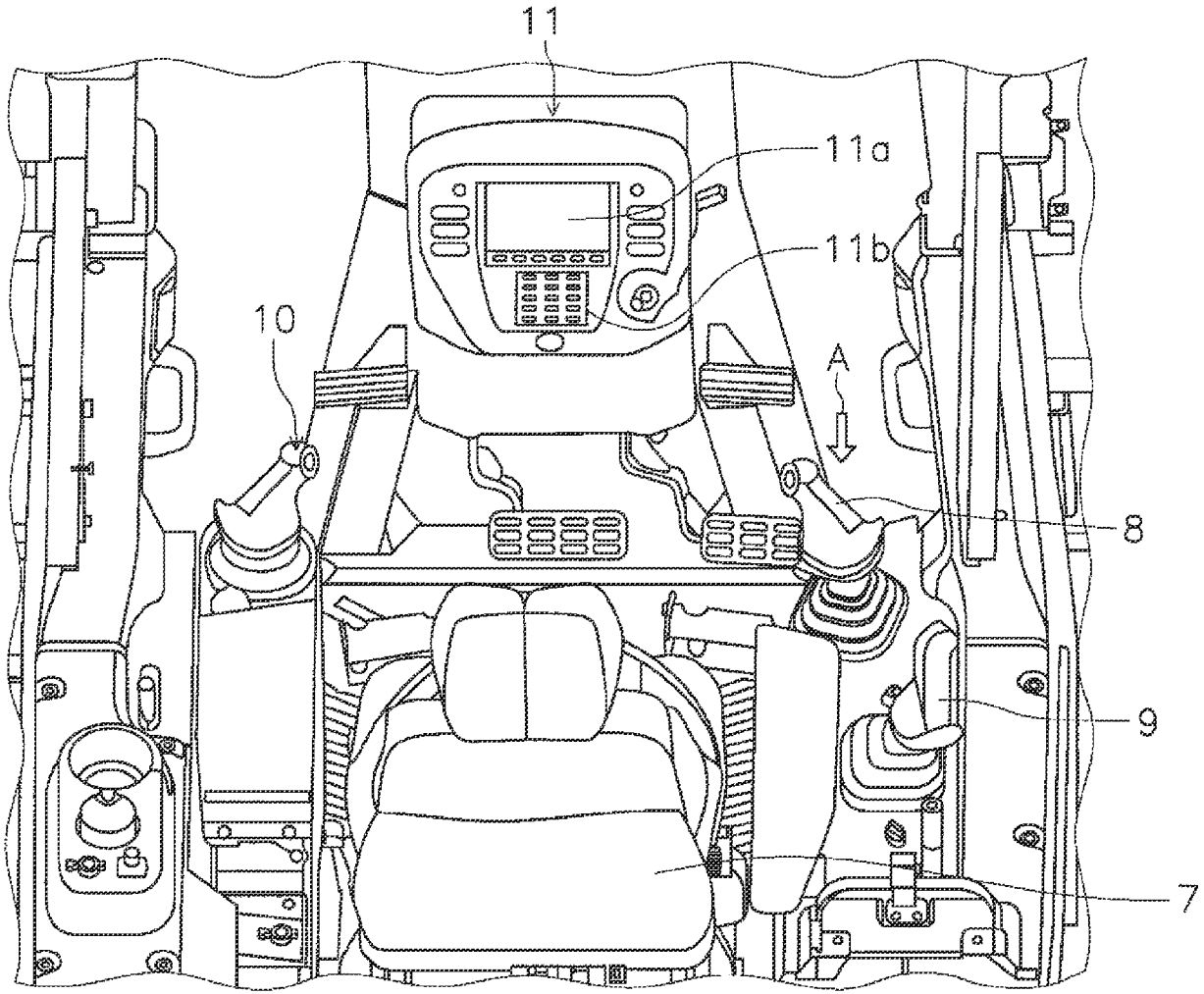
FIG. 3 is a perspective view illustrating an internal configuration of a cab 2 according to the embodiment.

The cab 2 accommodates an operator seat 7 adapted for an operator to be seated, as well as a variety of operating levers and the like (see FIG. 3). A description of an internal configuration of the cab 2 shall be provided below.

The vehicle body frame 3 supports the blade 4, the ripper 5, and the travel device 6. The cab 2 and an engine 21 (see FIG. 5) are situated on the vehicle body frame 3.

The blade 4 is attached to the front of the vehicle body frame 3. The blade 4 is a work machine for performing digging, earth moving, and earth removal. In the present embodiment, an angle of incline of the blade 4 relative to the ground (hereinbelow called the "pitch angle") can be automatically controlled (hereinbelow called "auto-pitch control") in accordance with a work mode of the blade 4.

Figure 2:
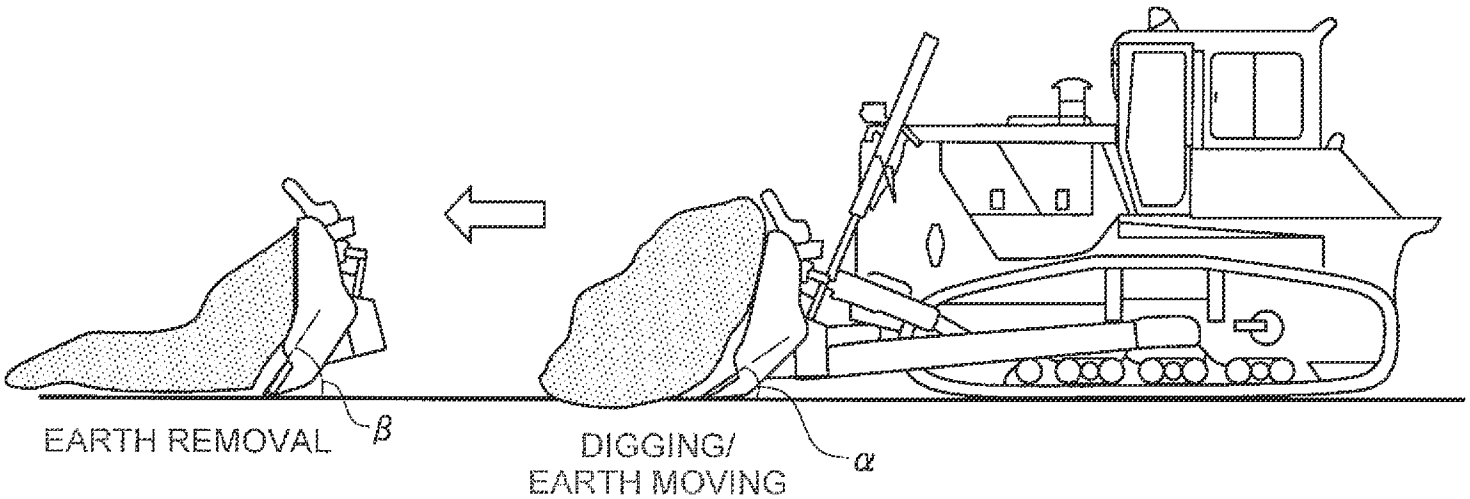
FIG. 2 is a drawing for describing the pitch angle of a blade 4 adapted for a work mode.

FIG. 2 is a drawing for describing the pitch angle adapted to a work mode. As illustrated in FIG. 2, a first angle $\alpha$ adapted for digging and earth moving is smaller than a second angle $\beta$ adapted for earth removal. A more detailed description of the auto-pitch control shall be provided below.

The blade 4 is lifted up and down by a blade lift, cylinder 41, and is tilted or pitched by a blade tilt cylinder 42. Causing the blade 4 to be pitched makes it possible to set the pitch angle. Causing the blade 4 to be tilted makes it possible to set the spacing between the ground and a lower right end or a lower left end of the blade 4.

The ripper 5 is attached to the rear of the vehicle body frame 3. The ripper 5 has a shank 5*a* and a ripper point 5*b*. The ripper point 5*b* is attached to a lower end of the shank 5*a*. The ripper point 5*b* is used for cutting and crushing rocks and the like, using the traction power of the travel device 6.

The ripper 5 is lifted up and down by a ripper lift cylinder 51, and is tilted by a ripper tilt cylinder 52.

The travel device 6 is attached at the lower part of the vehicle body frame 3. The independent rotation of a pair of track belts belonging to the travel device 6 makes it possible to change the course of the bulldozer 1.

The lifting of the blade 4, the tilting of the blade 4, the lifting of the ripper 5, the tilting of the ripper 5, and the course change of the bulldozer 1 are examples of a "predetermined action" according to the present embodiment. A "predetermined action" refers to an action different from a change to the pitch angle of the blade 4, and to an action necessitating that hydraulic oil be supplied from a main valve 23 (see FIG. 5).

Internal Configuration of Cab 2

A description of the internal configuration of the cab 2 according to the embodiment shall now be provided, with reference to the accompanying drawings. FIG. 3 is a perspective view illustrating the internal configuration of the cab 2 according to the embodiment.

The bulldozer 1 comprises, within the cab 2, the operator seat 7, a blade operating lever 8, a ripper operating lever 9, a steering operating lever 10, and a monitor 11.

The operator seat 7 is a seat where the operator is seated and performs a piloting action.

The blade operating lever 8 is disposed to the right side of the operator seat 7. The blade operating lever 8 drives the blade lift cylinder 41 for lifting the blade 4 as well as the blade tilt cylinder 42 for tilting or pitching the blade 4. The blade operating lever 8 transmits a blade operation signal Sb to a control device 100 (see FIG. 5) in accordance with the operation by the operator.

Figure 4:
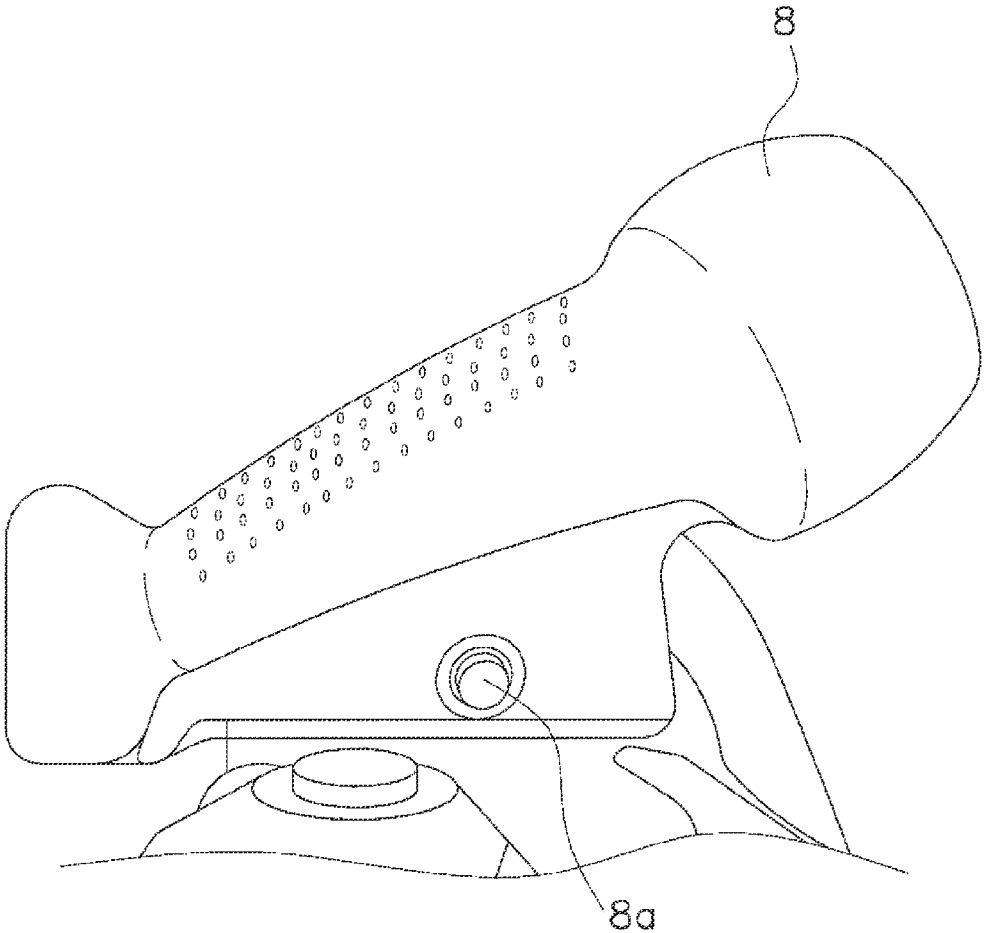
FIG. 4 is an arrow view in which a blade operating lever 8 is viewed from the direction of the arrow A in FIG. 3.

FIG. 4 is an arrow view in which the blade operating lever 8 is viewed from the direction of the arrow A in FIG. 3. The blade operating lever 8 has an auto-pitch button 8*a*. The auto-pitch button 8*a* receives, from the operator, an auto-pitch control initiation for the blade 4. Specifically, the operator presses the auto-pitch button 8*a* and a request for the pitch angle to be changed to an angle adapted for the work mode (the first angle $\alpha$ or the second angle $\beta$) is thereby received. In a case where the auto-pitch button 8*a* is pressed down by the operator, an auto-pitch request signal Sa to that effect is transmitted to the control device 100.

The ripper operating lever 9 is disposed to the rear of the blade operating lever 8. The ripper operating lever 9 drives the ripper lift cylinder 51 for lifting the ripper 5, as well as the ripper tilt cylinder 52 for tilting the ripper 5. The ripper operating lever 9 transmits a ripper operation signal Sr to the control device 100 in accordance with the operation by the operator.

The steering operating lever 10 receives, from the operator, a steering operation, i.e., course change, for the bulldozer 1. The operator operates the steering operating lever 10 and is thereby able to switch the speed stage of the transmission and also to execute a course change to the front, rear, left, and/or right. The steering operating lever 10 transmits a steering operation signal Sc to the control device 100 in accordance with the operation by the operator.

The monitor 11 is disposed in front of the operator seat 7. The monitor 11 displays the ON/OFF status of the auto-pitch control function as well as the execution status of the auto-pitch control. The monitor 11 has a main display unit 11*a* and a touch key display unit 11*b*. A description of an example of the display on the monitor 11 shall be provided below.

Configuration of Hydraulic Circuit 20

Figure 5:
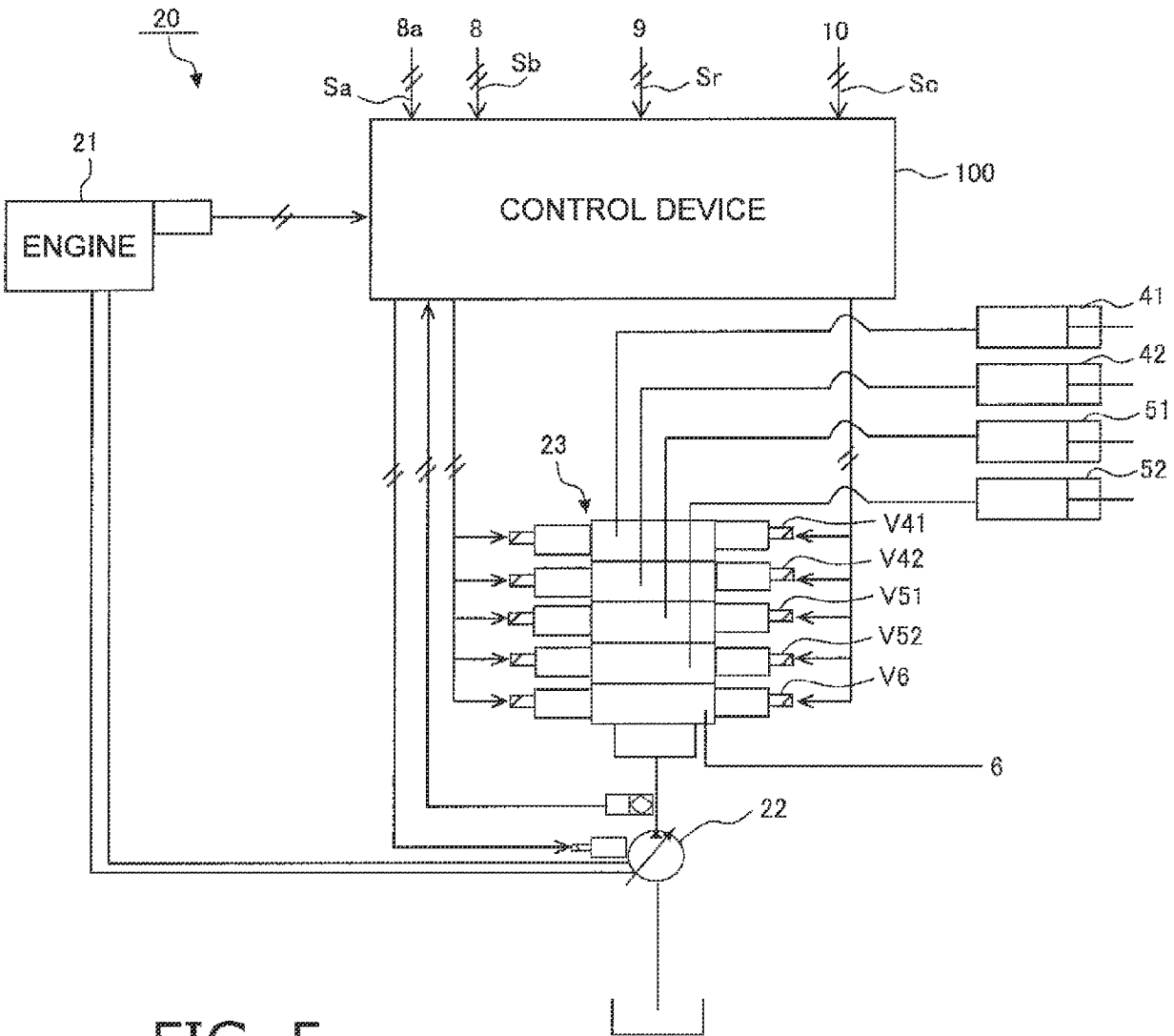
FIG. 5 is a circuit diagram illustrating a configuration of a hydraulic circuit 20 according to the embodiment.

A description of the configuration of the hydraulic circuit 20 according to the embodiment shall now be provided, with reference to the accompanying drawings. FIG. 5 is a circuit diagram illustrating the configuration of the hydraulic circuit 20 according to the embodiment.

The hydraulic circuit 20 comprises the engine 21, a hydraulic pump 22, the main valve 23, and the control device 100.

The engine 21 is situated on the vehicle body frame 3. The engine 21 supplies, to the hydraulic pump 22, a driving force associated with the rotational speed of the engine 21.

The hydraulic pump 22 is driven by the driving force supplied from the engine 21. The hydraulic pump 22 issues hydraulic oil to the main valve 23.

The main valve 23 distributes the hydraulic oil issued from the hydraulic pump 22 to the blade lift cylinder 41, the blade tilt cylinder 42, the ripper lift cylinder 51, the ripper tilt cylinder 52, and the travel device 6. The main valve 23 is composed of a blade lift cylinder valve V41, a blade tilt cylinder valve V42, a ripper lift cylinder valve V51, a ripper tilt cylinder valve V52, and a travel device valve V6. Each of the valves V is an electromagnetic proportional control valve, and an open ratio AP (inclusive of an "opening area" and "opening percentage") of each of the valves V can be controlled using an electrical current value outputted from the control device 100.

The control device 100 receives the blade operation signal Sb, the ripper operation signal Sr, and the steering operation signal Sc from the blade operating lever 8, the ripper operating lever 9, and the steering operating lever 10, respectively. The control device 100 uses a known method to control the main valve 23 in accordance with each of the received signals.

The control device 100 also receives the auto-pitch request signal Sa from the auto-pitch button 8*a*. The control device 100 executes the auto-pitch control in accordance with the auto-pitch request signal Sa. A description of the configuration and action of the control device 100 shall be provided below.

Configuration of Control Device 100

Figure 6:
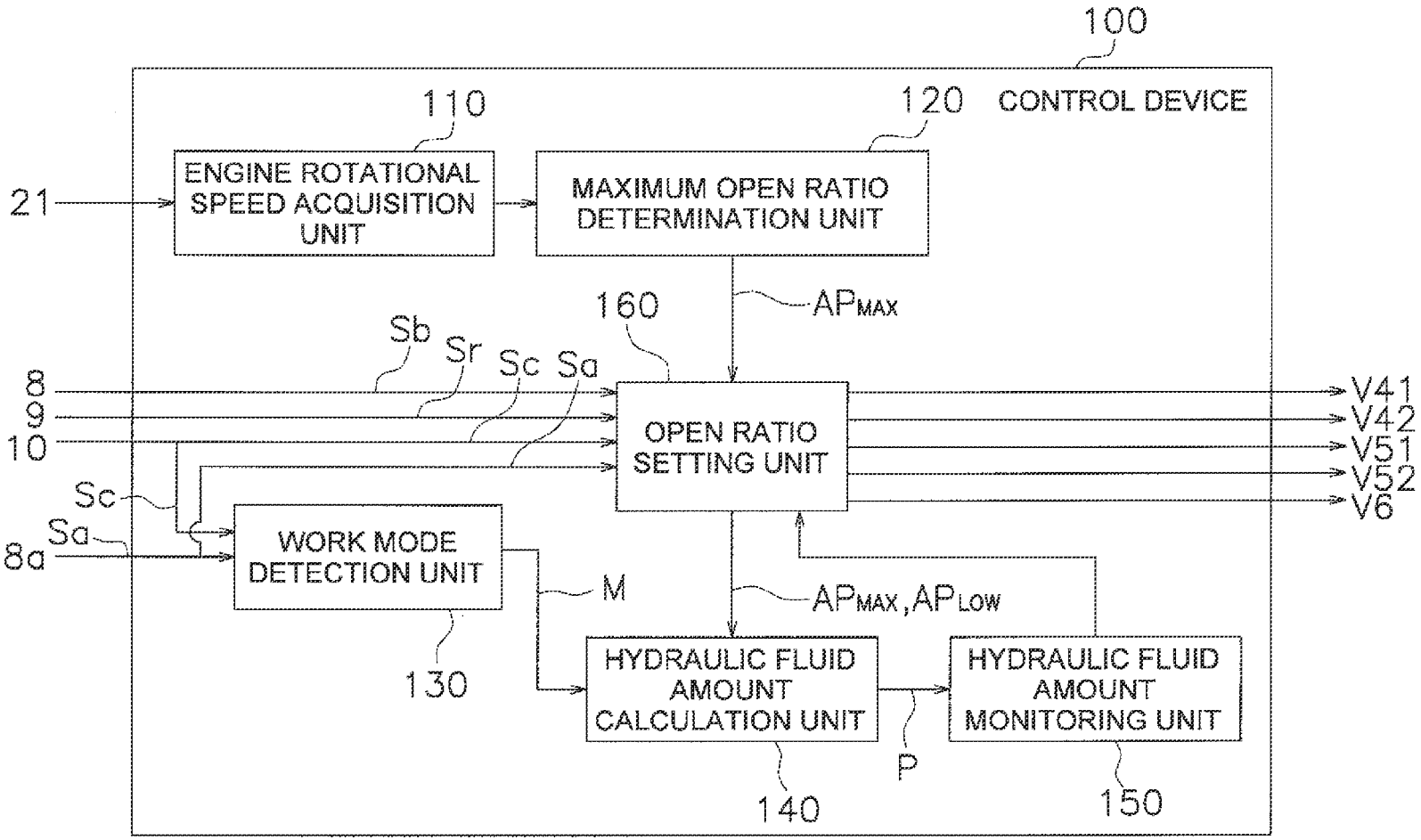
FIG. 6 is a block diagram illustrating the configuration of a control device 100 according to the embodiment.

A description of the configuration of the control device 100 according to the embodiment shall now be provided, with reference to the accompanying drawings. FIG. 6 is a block diagram illustrating the configuration of the control device 100 according to the embodiment.

The control device 100 comprises an engine rotational speed acquisition unit 110, a maximum open ratio determination unit 120, a work mode detection unit 130, a hydraulic oil amount calculation unit 140, a hydraulic oil amount monitoring unit 150, and an open ratio setting unit 160.

The engine rotational speed acquisition unit 110 acquires the rotational speed of the engine 21. The engine rotational speed acquisition unit 110 transmits the rotational speed of the engine 21 to the maximum open ratio determination unit 120 in real time.

Figure 7:
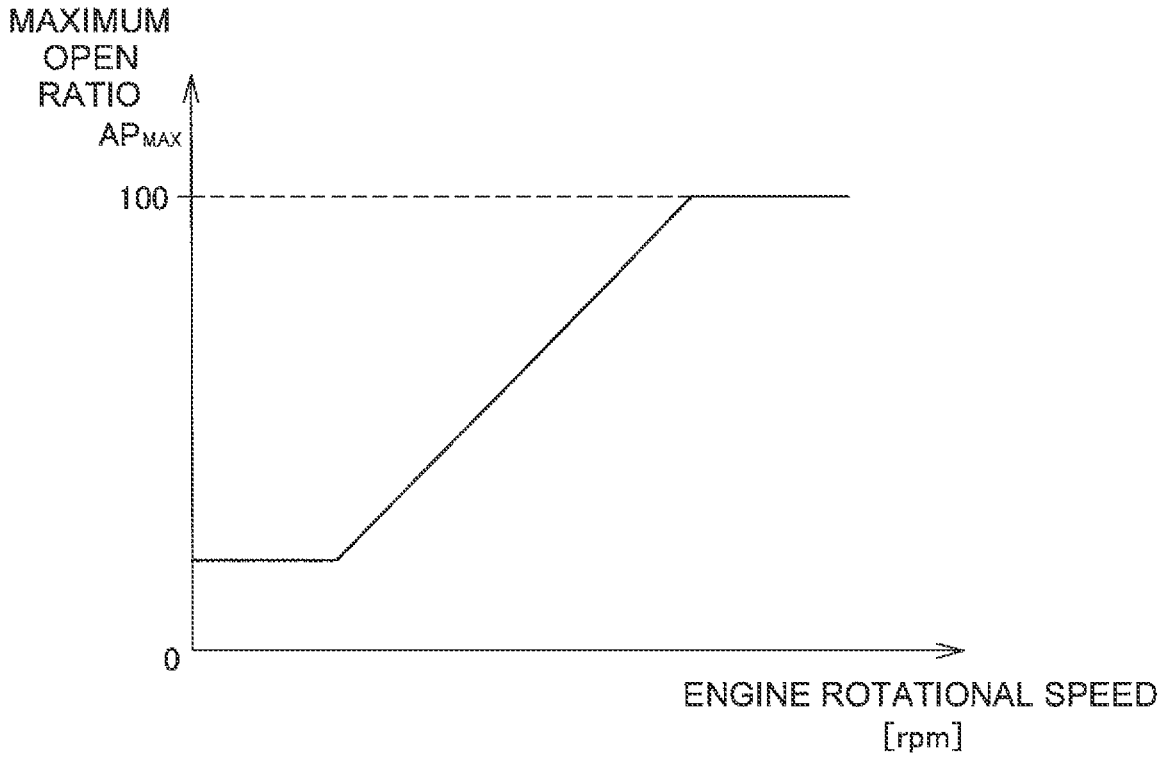
FIG. 7 is a graph illustrating the relationship between a rotational speed of an engine 21 and a maximum open ratio $AP_{MAX}$.

The maximum open ratio determination unit 120 determines the maximum value of the open ratio AP (hereinbelow called the "maximum open ratio $AP_{MAX}$") of each of the valves V, in accordance with the rotational speed of the engine 21. FIG. 7 is a graph illustrating the relationship between the rotational speed of the engine 21 and the maximum open ratio $AP_{MAX}$. The maximum open ratio determination unit 120 sets a larger maximum open ratio $AP_{MAX}$ for a higher rotational speed of the engine 21, on the basis of FIG. 7. The maximum open ratio determination unit 120 transmits the maximum open ratio $AP_{MAX}$ to the open ratio setting unit 160 in real time.

The work mode detection unit 130 receives the auto-pitch request signal Sa and the steering operation signal Sc. The work mode detection unit 130 detects a subsequent work mode M of the blade 4 on the basis of the received auto-pitch request signal Sa and steering operation signal Sc. Specifically, in a case where the auto-pitch request signal Sa has been received during forward motion, the work mode detection unit 130 detects the subsequent work mode M as being digging and earth moving, or as being earth removal, in alternation. In a case where the auto-pitch request signal Sa has been received during reverse motion, the work mode detection unit 130 detects the subsequent work mode M as being digging and earth moving. The work mode detection unit 130 transmits the detected subsequent work mode M of the blade 4 to the hydraulic oil amount calculation unit 140.

The hydraulic oil amount calculation unit 140 receives the maximum open ratio $AP_{MAX}$ from the open ratio setting unit 160, as well as a low open ratio $AP_{LOW}$ (described below), in real time. The hydraulic oil amount calculation unit 140 calculates an amount of hydraulic oil P passing through the blade tilt cylinder valve V42 (i.e., the amount of hydraulic oil being supplied to the blade tilt cylinder 42), in accordance with the receipt of the subsequent work mode M. The amount of hydraulic oil P can be calculated on the basis of the maximum open ratio $AP_{MAX}$, the low open ratio $AP_{LOW}$, and the opening time of the blade tilt cylinder valve V42. The hydraulic oil amount calculation unit 140 notifies the hydraulic oil amount monitoring unit 150 of the calculated amount of hydraulic oil P.

The hydraulic oil amount monitoring unit 150 monitors whether or not the amount of hydraulic oil P as calculated by the hydraulic oil amount calculation unit 140 has reached a predetermined amount of hydraulic oil Q required for the change to the subsequent work mode M.

Herein, the predetermined amount of hydraulic oil Q in a case where the change is from "digging and earth moving" to "earth removal" is the amount of hydraulic oil required in order to cause the stroke of the blade tilt cylinder 42 to be such that the pitch angle of the blade 4 moves from the first angle $\alpha$ to the second angle $\beta$. Conversely, the predetermined amount of hydraulic oil Q in a case where the change is from "earth removal" to "digging and earth moving" is the amount of hydraulic oil required in order to cause the stroke of the blade tilt cylinder 42 to be such that the pitch angle of the blade 4 moves from the second angle $\beta$ to the first angle $\alpha$. The amount of hydraulic oil required in order to make the change from "digging and earth moving" to "earth removal" and the amount of hydraulic oil required in order to make the change from "earth removal" to "digging and earth moving" may be the same.

In a case where the calculated amount of hydraulic oil P has reached the predetermined amount of hydraulic oil Q, the hydraulic oil amount monitoring unit 150 notifies the open ratio setting unit 160 to that effect.

The open ratio setting unit 160 receives the blade operation signal Sb, the ripper operation signal Sr, and the steering operation signal Sc. The open ratio setting unit 160 uses a known technique to control each of the valves V (including the blade lift cylinder valve V41, the blade tilt cylinder valve V42, the ripper lift cylinder valve V51, and the ripper tilt cylinder valve V52) in accordance with each of the received operation signals. Herein, the open ratio setting unit 160 sets the open ratio AP of each of the valves V to be the maximum open ratio $AP_{MAX}$ as received from the maximum open ratio determination unit 120.

The open ratio setting unit 160 receives the auto-pitch request signal Sa from the auto-pitch button 8*a*. The open ratio setting unit 160 executes the auto-pitch control in accordance with the receipt of the auto-pitch request signal Sa. Specifically, the open ratio setting unit 160 causes the blade tilt cylinder valve V42 to open at the maximum open ratio $AP_{MAX}$. Thereafter, the open ratio setting unit 160 causes the tilt cylinder valve V42 to close in a case where a notification that the calculated amount of hydraulic oil P has reached the predetermined amount of hydraulic oil Q has been acquired from the hydraulic oil amount monitoring unit 150.

Herein, the open ratio setting unit 160 causes the open ratio AP of the blade tilt cylinder valve V42 to be smaller than the maximum open ratio $AP_{MAX}$ upon receipt of a request for a "predetermined action" from the operator during execution of the auto-pitch control. Specifically the open ratio setting unit 160 causes the blade tilt cylinder valve V42 to close temporarily (i.e., causes the open ratio to become smaller until "0") upon receipt of a request for a tilting of the blade 4, a lifting of the ripper 5, or a tilting of the ripper 5. The auto-pitch control is thereby interrupted. The open ratio setting unit 160 causes the open ratio of the blade tilt cylinder valve V42 to be smatter until the low open ratio $AP_{LOW}$ (which is, for example, about 50% of the maximum open ratio $AP_{MAX}$) upon receipt of a request for lifting of the blade 4, or for a course change of the bulldozer 1. The auto-pitch control is thereby delayed.

As noted above, a "predetermined action" refers to an action different from a change to the pitch angle of the blade 4, and to an action necessitating that hydraulic oil be supplied from the main valve 23 (see FIG. 5). The open ratio setting unit 160 detects that the predetermined action has been requested, on the basis of the blade operation signal Sb, the ripper operation signal Sr, and the steering control signal Sc.

The open ratio setting unit 160 causes each of the valves V corresponding to the predetermined action to open while the request for the predetermined action is being received. The open ratio setting unit 160 causes each of the valves V corresponding to the predetermined action to close in a case where the request for the predetermined action has been completed.

Further, upon receipt of a request for a "change to the pitch angle of the blade 4" from the operator during execution of the auto-pitch control, the open ratio setting unit 160 sets the open ratio AP of the blade tilt cylinder valve V42 in conformity with the request by the operator. The auto-pitch control is thereby automatically completed.

The open ratio setting unit 160 causes the monitor 11 to display that the auto-pitch control is being executed, during the execution of the auto-pitch control. While the open ratio AP is being made smaller than the maximum open ratio $AP_{MAX}$ during the execution of the auto-pitch control, the open ratio setting unit 160 causes the monitor 11 to produce a display to that effect. A description of an example of the display of the monitor 11 shall be provided below.

Action of Control Device 100

Figure 8:
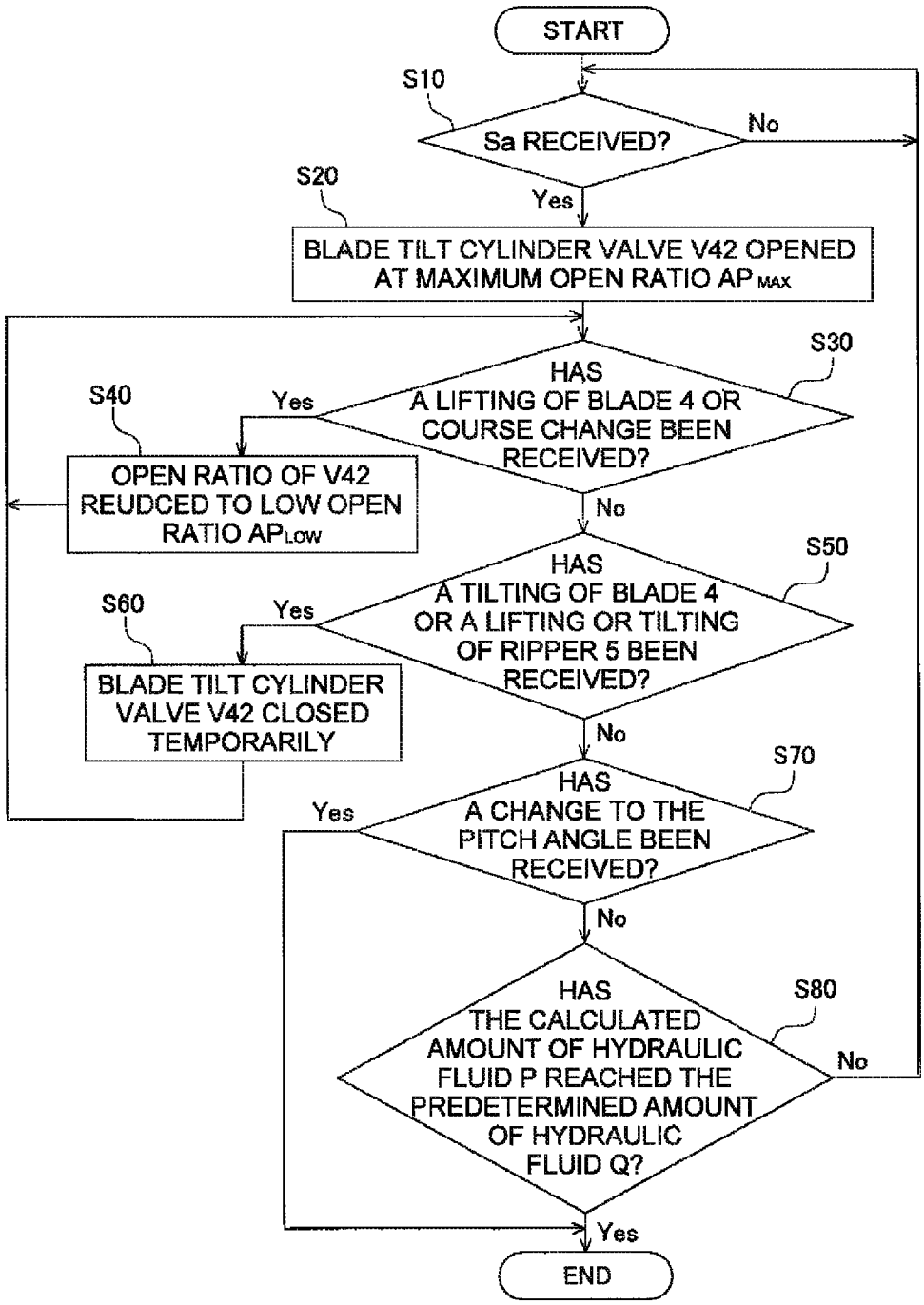
FIG. 8 is a flow chart illustrating an action of the control device 100 according to the embodiment.

A description of the action of the control device 100 according to the embodiment shall now be provided, with reference to the accompanying drawings. FIG. 8 is a flow chart illustrating the action of the control device 100 according to the embodiment. Hereinbelow, the description primarily relates to the action of the auto-pitch control.

In step S10, the control device 100 decides whether or not the auto-pitch request signal Sa has been received. In a case where the auto-pitch request signal Sa has been received, the process proceeds to step S20. In a case where the auto-pitch request signal Sa has not been received, the process repeats step S10.

In step S20, the control device 100 causes the blade tilt cylinder valve V42 to open at the maximum open ratio $AP_{MAX}$. The auto-pitch control is thereby begun.

In step S30, the control device 100 decides whether or not a request for a course change or a lifting of the blade 4 has been received from the operator. In a case where the request has been received from the operator, the process proceeds to step S40. In a case where the request has not been received from the operator, the process proceeds to step S50.

In step S40, the control device 100 reduces the open ratio of the blade tilt cylinder valve V42 from the maximum open ratio $AP_{MAX}$ to the low open ratio $AP_{LOW}$. The auto-pitch control is thereby delayed. Thereafter, the process returns to step S30.

In step S50, the control device 100 decides whether or not a request for a tilting of the blade 4, a lifting of the ripper 5, or a tilting of the ripper 5 has been received from the operator. In a case where the request has been received from the operator, the process proceeds to step S60. In a case where the request has not been received from the operator, the process proceeds to step S70.

In step S60, the control device 100 causes the blade tilt cylinder valve V42 to close temporarily. The auto-pitch control is thereby interrupted. Thereafter, the process returns to step S30.

In step S70, the control device 100 decides whether or not a request for a change to the pitch angle of the blade 4 has been received from the operator. In a case where the request has been received from the operator, the auto-pitch control is automatically completed. In a case where the request has not been received from the operator, the process proceeds to step S80.

In step S80, the control device 100 decides whether or not the calculated amount of hydraulic oil P has reached the predetermined amount of hydraulic oil Q. In a case where the predetermined amount of hydraulic oil Q has been reached, the process is completed. In a case where the predetermined amount of hydraulic oil Q has not been reached, the process returns to step S10, whereby the auto-pitch control is continued.

Example of Display on Monitor 11

Figure 9:
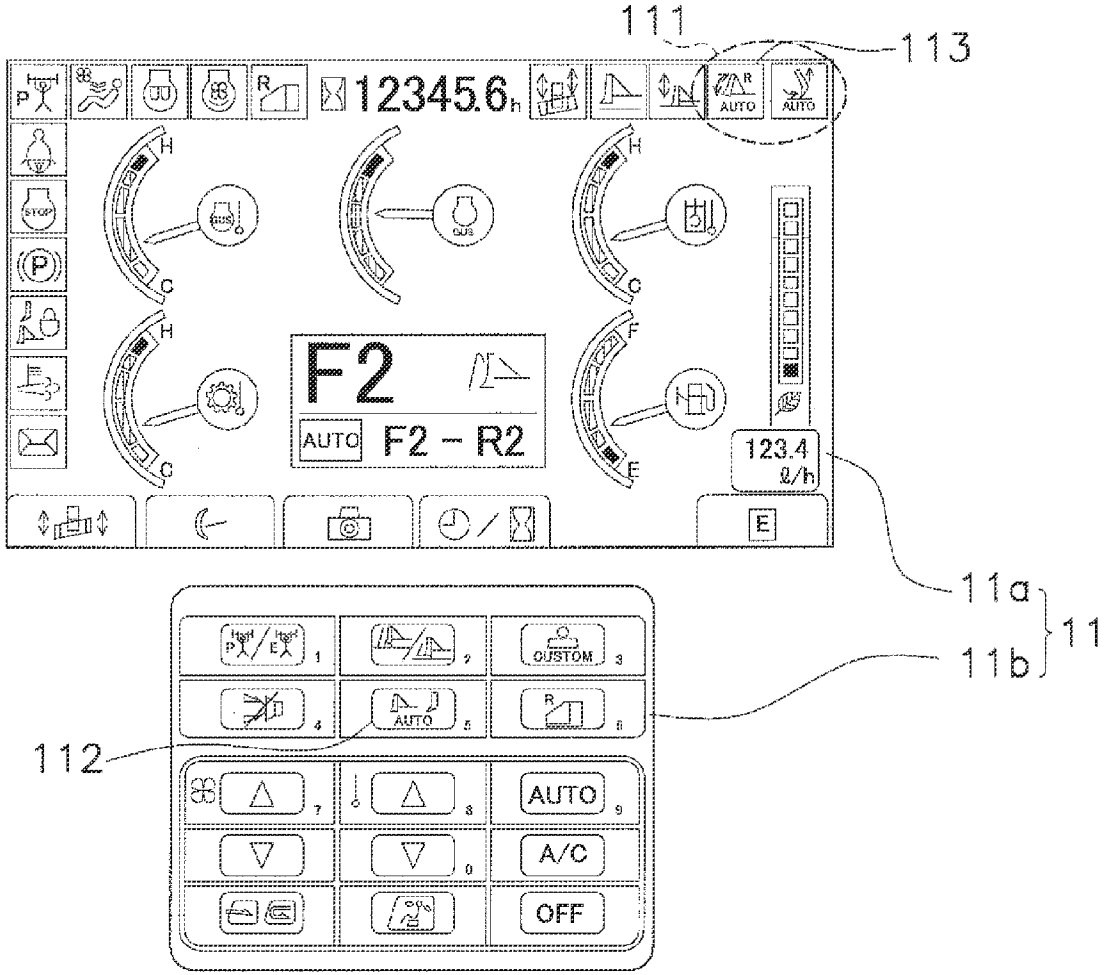
FIG. 9 is a schematic view illustrating an example of a display of a monitor 11 according to the embodiment.

A description of an example of the display on the monitor 11 according to the embodiment shall now be provided, with reference to the accompanying drawings. FIG. 9 is a schematic view illustrating the example of the display of the monitor 11 according to the embodiment.

The monitor 11 has a main display unit 11*a* and a touch key display unit 11*b*. The main display unit 11*a* displays a variety of functions and the statuses thereof. The touch key display unit 11*b* displays a variety of touch keys for switching the variety of functions to ON/OFF or for switching modes thereof.

The main display unit 11*a* has an auto-pitch control display region 111. The auto-pitch control display region 111 is a region for displaying the ON/OFF status of the auto-pitch control function and the execution status of the auto-pitch control.

An auto-pitch control function ON/OFF button 112 is displayed on the touch key display unit 11*b*. The auto-pitch control function ON/OFF button 112 is a touch button for switching the ON/OFF status of the auto-pitch control function.

Firstly, in a case where the operator starts the bulldozer 1 using a key the auto-pitch control function is OFF as the initial state, and no display is produced on the auto-pitch control display region 111.

Subsequently, when the operator touches the auto-pitch control function ON/OFF button 112, the auto-pitch control function is turned ON, and an auto-pitch control function ON icon 113 is lit blue or green in the auto-pitch control display region 111.

Subsequently, when the operator presses down on the auto-pitch button 8*a*, the auto-pitch control is initiated, and the auto-pitch control function ON icon 113 is lit yellow.

Subsequently, when the operator requests a predetermined action, the auto-pitch control function ON icon 113 flashes. A communication is thereby produced for the operator that the open ratio AP of the blade tilt cylinder valve V42 is being made smaller than the maximum open ratio $AP_{MAX}$ (i.e., that the auto-pitch control is being delayed or interrupted).

Subsequently, in a case where the request made by the operator for the predetermined action has been completed, the auto-pitch control function ON icon 113 is restored to a lit state.

Subsequently, in a case where the execution of the auto-pitch control has been completed, the auto-pitch control function ON icon 113 is unlit.

Actions and Effects (1) The control device 100 according to the present embodiment comprises the open ratio setting unit 160. The open ratio setting unit 160 causes the blade tilt cylinder valve V42 to open at the maximum open ratio $AP_{MAX}$ in a case where a request for the pitch angle of the blade 4 to be changed from the first angle $\alpha$ to the second angle $\beta$ has been received from the operator. The open ratio setting unit 160 causes the blade tilt cylinder valve V42 to close in a case where the calculated amount of hydraulic oil P has reached the predetermined amount of hydraulic oil Q. Also, the open ratio setting unit causes the open ratio AP of the blade tilt cylinder valve V42 to be smaller than the maximum open ratio $AP_{MAX}$ while a request for a predetermined action necessitating that hydraulic oil be supplied from the main valve 23 is being received from the operator.

In this manner, the open ratio AP of the blade tilt cylinder valve V42 is made smaller in a case where the hydraulic oil of the main valve 23 is used for the predetermined action during the execution of the at to-pitch control. For this reason, because hydraulic oil from the entire opening of the blade tilt cylinder valve V42 is more readily supplied to the blade tilt cylinder 42, the occurrence of error between the amount of hydraulic oil P calculated by the hydraulic oil amount calculation unit 140 and the predetermined amount of hydraulic oil Q can be suppressed. Accordingly, because the stroke of the blade tilt cylinder 42 can be detected with precision, the pitch angle of the blade 4 can be controlled with precision.

(2) The control device 100 causes the blade tilt cylinder valve V42 to close in a case where the predetermined action is a tilting of the blade 4, a lifting of the ripper 5, or a tilting of the ripper 5.

In this manner, the auto-pitch control is interrupted in a case where it is necessary to supply a large amount of hydraulic oil from the main valve 23. For this reason, there is no need to make the difficult prediction of the extent to which the open ratio AP of the blade tilt cylinder valve V42 should be made smaller. Accordingly, the occurrence of error between the calculated amount of hydraulic oil P and the predetermined amount of hydraulic oil Q can be further suppressed, and therefore the pitch angle of the blade 4 can be controlled with greater precision.

(3) In a case where a request to change the pitch angle of the blade 4 has been received from the operator, the control device 100 sets the open ratio AP in conformity with the request from the operator.

In this manner, operation by the operator is given priority even during the execution of the auto-pitch control in a case where the operator wishes to independently change the pitch angle. For this reason, the degree of freedom of operation by the operator can be improved.

(4) While the open ratio AP is being made smaller than the maximum open ratio $AP_{MAX}$, the control device 100 causes the monitor 11 to produce a display to that effect.

Accordingly, it is possible to effectively communicate to the operator that the auto-pitch control has been interrupted and/or that the auto-pitch control is being delayed.

Other Embodiments

Although a recitation of the present invention has been made using the embodiment described above, these statements and drawings form only a part of the present disclosure and are not to be interpreted as limiting the present invention. A variety of alternative modes of carrying out the present invention, as well as embodiments and action techniques, shall be apparent to the person having ordinary skill in the art, on the basis of the present disclosure.

(A) In the embodiment described above, the bulldozer 1 comprised the ripper 5, but the bulldozer 1 may also not comprise the ripper 5.

(B) in the embodiment described above, the control device 100 reduces the open ratio of the blade tilt cylinder valve V42 in a case where a request for a lifting of the blade 4 or for a course change has been received during execution of the auto-pitch control, but the blade tilt cylinder valve V42 may also be closed.

(C) In the embodiment described above, the control device 100 causes the blade tilt cylinder valve V42 to close in a case where a request for a tilting of the blade 4, for a lifting of the ripper 5, or for a tilting of the ripper 5 has been received during the execution of the auto-pitch control, but the open ratio of the blade tilt cylinder valve V42 may also be reduced.

(D) In the embodiment described above, the description is of an instance where the pitch angle of the blade 4 is changed between the first angle α, adapted for digging and earth moving, and the second angle β, adapted for earth removal, but there is no limitation thereto. The pitch angle of the blade 4 may be changed between the first angle α, adapted for digging, the second angle β, adapted for earth removal, and a third angle γ, adapted for earth-moving.

(E) Although not mentioned in particular in the embodiment described above, the control device 100 may acquire a maximum stroke position and minimum stroke position of the blade tilt cylinder 42 in a case where the steering operating lever 10 designates reverse motion or neutral, whereby the pitch angle of the blade 4 may be reset to a predetermined standard angle (for example, the first angle α, or the like). This makes it possible to control the pitch angle of the blade 4 with greater precision, because any increase in the error whenever the auto-pitch control is being executed can be suppressed.

It will thus be readily understood that the present invention includes a variety of embodiments not recited herein. Accordingly, the technical scope of the present invention is to be established only by the specific inventive matter set forth in the claims as deemed to be proper from the description above.

According to the control device and pitch angle control method according to the illustrated embodiments, the pitch angle of a blade can be controlled with precision; therefore, the control device and control method according to the illustrated embodiments are useful in the field of construction machine.

What is claimed is:

1. A control device for automatically controlling a pitch angle of a blade relative to the ground, the control device being provided to construction machine including the blade, a blade tilt cylinder and a blade tilt cylinder valve constituting a part of a main valve, the blade tilt cylinder valve being linked to the blade tilt cylinder, the control device comprising:

a hydraulic oil amount calculation unit configured to calculate an amount of hydraulic oil passing through the blade tilt cylinder valve based on an open ratio and a cumulative time of opening of the blade tilt cylinder valve; and an open ratio setting unit configured to cause the blade tilt cylinder valve to open at a predetermined open ratio when a request for the pitch angle to be changed from a first angle to a second angle has been received, the open ratio setting unit being configured to cause the blade tilt cylinder valve to close when the calculated amount of hydraulic oil has reached a predetermined amount of hydraulic oil required for the change from the first angle to the second angle, the open ratio setting unit being configured to cause the open ratio to be smaller than the predetermined open ratio while a request for a predetermined action necessitating that hydraulic oil be supplied from the main valve is being received.

2. The control device according to claim 1, wherein the predetermined action is lifting of the blade.

3. The control device according to claim 1, wherein the predetermined action is a course change.

4. The control device according to claim 1, wherein the predetermined action is tilting of the blade.

5. The control device according to claim 1, wherein the predetermined action is lifting of a ripper for excavation.

6. The control device according to claim 1, wherein the predetermined action is tilting of a ripper for excavation.

7. The control device according to claim 1, wherein the open ratio setting unit is configured to cause the blade tilt cylinder valve to be closed while the request for the predetermined action is being received.

8. The control device according to claim 1, wherein when the request for the change to the pitch angle has been received, the open ratio setting unit sets the open ratio in conformity with the received request.

9. The control device according to claim 1, wherein the open ratio setting unit is configured to cause a monitor to display that the open ratio is being made smaller than the predetermined open ratio while the open ratio is being made smaller than the predetermined open ratio.

10. The control device according to claim 1, further comprising:

an engine rotational speed acquisition unit configured to acquire a rotational speed of an engine, and a maximum open ratio determination unit configured to determine a maximum open ratio of the blade tilt cylinder valve, in accordance with the rotational speed of the engine, wherein the predetermined open ratio is the maximum open ratio.

11. The control device according to claim 1, further comprising a hydraulic oil amount monitoring unit configured to monitor whether or not the calculated amount of hydraulic oil has reached the predetermined amount of hydraulic oil required for the change from the first angle to the second angle, wherein the hydraulic oil amount monitoring unit communicates to the open ratio setting unit that the calculated amount of hydraulic oil has reached the predetermined amount of hydraulic oil.

12. The control device according to claim 1, further comprising a work mode detection unit configured to detect a subsequent work mode of the blade, in accordance with a work mode of the blade when the request for the pitch angle to be changed from the first angle to the second angle has been received, wherein the predetermined amount of hydraulic oil is set in accordance with the detected subsequent work mode.

13. A bulldozer comprising:

a blade;

a blade tilt cylinder configured to drive the blade;

a main valve including a blade tilt cylinder valve linked to the blade tilt cylinder;

a hydraulic pump configured to supply hydraulic oil to the main valve, the hydraulic pump driven by an engine; and a control device configured to automatically control a pitch angle of the blade relative to the ground, the control device having a hydraulic oil amount calculation unit and an open ratio setting unit, the hydraulic oil amount calculation unit being configured to calculate an amount of hydraulic oil passing through the blade tilt cylinder valve based on an open ratio and a cumulative time of opening of the blade tilt cylinder valve, and the open ratio setting unit being configured to cause the blade tilt cylinder valve to open at a predetermined open ratio when a request for the pitch angle to be changed from a first angle to a second angle has been received, the open ratio setting unit being configured to cause the blade tilt cylinder valve to close when the calculated amount of hydraulic oil has reached a predetermined amount of hydraulic oil required for the change from the first angle to the second angle, the open ratio setting unit being configured to cause the open ratio to be smaller than the predetermined open ratio while a request for a predetermined action necessitating that hydraulic oil be supplied from the main valve is being received.

14. A pitch angle control method for automatically controlling a pitch angle of a blade relative to the ground in construction machine including the blade, a blade tilt cylinder, and a blade tilt cylinder valve constituting a part of a main valve, the blade tilt cylinder valve being linked to the blade tilt cylinder, the method comprising:

opening the blade tilt cylinder valve at a predetermined open ratio when a request for the pitch angle to be changed from a first angle to a second angle has been received;

setting the open ratio to be smaller than the predetermined open ratio while a request for a predetermined action necessitating that hydraulic oil be supplied from the main valve is being received;

calculating an amount of hydraulic oil passing through the blade tilt cylinder valve based on an open ratio and a cumulative time of opening of the blade tilt cylinder valve; and closing the blade tilt cylinder valve when the calculated amount of hydraulic oil has reached a predetermined amount of hydraulic oil required for the change from the first angle to the second angle.

* * * * *